US009487224B1

(12) United States Patent
Pless et al.

(10) Patent No.: US 9,487,224 B1
(45) Date of Patent: Nov. 8, 2016

(54) MECHANICALLY EXTENDABLE RAILROAD CROSSING GATE

(71) Applicant: SIEMENS INDUSTRY, INC., Alpharetta, GA (US)

(72) Inventors: Travis Pless, Waddy, KY (US); Barton DeJarnatt, Lousville, KY (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 14/860,764

(22) Filed: Sep. 22, 2015

(51) Int. Cl.

| | |
|---|---|
| ***B61L 29/04*** | (2006.01) |
| ***E01F 13/06*** | (2006.01) |
| ***E06B 3/92*** | (2006.01) |
| ***E05F 15/646*** | (2015.01) |
| ***E05F 15/643*** | (2015.01) |

(52) U.S. Cl.
CPC ..... *B61L 29/04* (2013.01); *E01F 13/06* (2013.01); *E05F 15/643* (2015.01); *E05F 15/646* (2015.01); *E06B 3/921* (2013.01)

(58) Field of Classification Search
CPC ..... B61L 29/04; B61L 29/06
USPC ..... 49/49, 254; 246/293, 125
See application file for complete search history.

(56) References Cited

U.S. PATENT DOCUMENTS

| | | | | |
|---|---|---|---|---|
| 4,519,164 | A * | 5/1985 | Porter | E06B 11/04 49/108 |
| 4,864,772 | A * | 9/1989 | Ecklund | E06B 11/04 49/386 |
| 5,469,660 | A * | 11/1995 | Tamenne | E01F 13/06 49/192 |
| 6,189,839 | B1 * | 2/2001 | Lemieux | E01F 13/048 246/127 |
| 6,792,716 | B1 * | 9/2004 | Luster | E01F 13/06 49/387 |
| 7,356,966 | B2 * | 4/2008 | Burke | B61L 29/04 49/49 |
| 7,384,017 | B1 * | 6/2008 | Burke | B61L 29/04 246/125 |
| 2005/0139730 | A1 * | 6/2005 | Zarkades | B61L 29/04 246/473.1 |
| 2008/0061561 | A1 * | 3/2008 | Uryasov | E05B 47/026 292/40 |

FOREIGN PATENT DOCUMENTS

DE GB 191328365 A * 5/1914 ..... B61L 29/243

* cited by examiner

*Primary Examiner* — Katherine Mitchell
*Assistant Examiner* — Marcus Menezes

(57) ABSTRACT

A system for operating a gate arm of a railroad crossing gate is provided. The system includes a lever, a spring attached to an extendable gate arm, a cable mechanism including a cable and a crossing mechanism. The lever is movably coupled to the cable and the spring is coupled to the cable. The lever is coupled to the crossing mechanism and the cable is coupled to the crossing mechanism. The cable mechanism is configured to extend and retract the extendable gate arm and the lever is configured to enable the spring to pull the extendable arm out from a retracted position.

6 Claims, 3 Drawing Sheets

MECHANICALLY EXTENDABLE RAILROAD CROSSING GATE

BACKGROUND

1. Field

Aspects of the present invention generally relate to crossing gates and more specifically relates to a railroad crossing gate for use at an intersection of a roadway and a railway track.

2. Description of the Related Art

Railroad grade level crossing gates generally have a relatively long fixed gate arm. Due to the long length of the gate arm the railroad crossing gate is more likely to suffer wind damage and interfere with overhead obstructions such as power lines. If the gate arm is damaged in a wind event or is damaged due to overhead obstacles, maintenance crews have to be dispatched to fix the damaged arms or temporarily post warning flags to warn motorists. There is also the issue of vehicles being "trapped" in the railway crossings by the gate arms.

Railroad grade crossing assemblies with fixed arms use crossing warning signs with or without flashing warning lights. Some railroad grade level crossings employ "quad gates" that block both lanes of traffic on both sides of the grade crossing, but this requires twice the hardware and maintenance than a standard grade crossing due to double the arms.

Therefore, there is a need for improvements to railroad crossing gates.

SUMMARY

Railroad companies, therefore, have a desire to have a gate with an arm such that it closes the railway crossing yet the gate arm remains relatively short when in the "up" position. The gate arm also should mechanically operate in the event of a power failure to insure the railway crossing is blocked.

Briefly described, aspects of the present invention relate to a railroad crossing gate with a mechanically extendable gate arm. In particular, means for extending the length of the gate comprises a telescoping arm, a lever, a spring and a cable mechanism that are used to hold and release tension which in turn extends and retracts a gate arm of a railroad crossing gate. One of ordinary skill in the art appreciates that such an extending and retracting gate arm can be configured to be installed in different environments where a gate for a crossing is needed, for example, in a gate of a railway crossing.

In accordance with one illustrative embodiment of the present invention, by using a lever, a spring and a cable mechanism to hold and release tension a gate arm of a railroad crossing gate can be in turn extended and retracted. This tension is controlled by the lever attached to a crossing mechanism so that when the gate arm is lowered, slack is introduced into a cable of the cable mechanism thereby allowing the spring to pull an extendable arm from its base. Since this assembly is 100% mechanically operated, it negates the need for any solar panels, battery backup or any electro-mechanical devices to drive the gate arm in and out. The reliability of this mechanical design drastically increases reliability.

Additionally, if an automobile or pedestrian were "trapped" in the crossing, the spring loaded arm could be easily retracted by hand via a handle attached to a retractable arm of the gate arm, thus allowing the automobile or pedestrian to pass through the crossing.

In accordance with another illustrative embodiment of the present invention, a system for operating a gate arm of a railroad crossing gate is provided. The system includes a lever, a spring attached to an extendable gate arm, a cable mechanism including a cable and a crossing mechanism. The lever is movably coupled to the cable and the spring is coupled to the cable. The lever is coupled to the crossing mechanism and the cable is coupled to the crossing mechanism. The cable mechanism is configured to extend and retract the extendable gate arm and the lever is configured to enable the spring to pull the extendable arm out from a retracted position.

In accordance with yet another illustrative embodiment of the present invention, a system for mechanically extending or retracting a gate arm of a railroad crossing gate is provided. The system comprises a lever having a first roller, a spring having first and second ends, a cable mechanism and a crossing mechanism. The spring on the first end is coupled to a first lug that is fixedly attached to a fixed portion of an extendable gate arm and the spring on the second end is coupled to a second lug that is fixedly attached to the extendable gate arm. The cable mechanism includes a second roller and a cable having first and second ends. The lever is movably coupled to the cable and the second end of the spring is coupled to the first end of the cable. The lever is attached to the crossing mechanism and the second end of the cable is coupled to the crossing mechanism. The cable mechanism is configured to hold and release a tension that in turn extends and retracts the extendable gate arm. The lever is configured to control the tension so that when the extendable gate arm is lowered a slack is introduced into the cable thereby enabling the spring to pull the extendable arm out from a base position in which the extendable gate arm is retracted.

In accordance with yet another illustrative embodiment of the present invention, a system for operating a gate arm of a railroad crossing gate is provided. The system comprises a telescopic gate arm including a first arm and a second arm for housing the first arm. The system further comprises means for coupling the telescopic gate arm to a post of the railroad crossing gate. The system further comprises means for mechanically extending the first arm of the telescopic gate arm out of the second arm of the telescopic gate arm when the railroad crossing gate is in a closed position. The system further comprises means for mechanically retracting the first arm of the telescopic extendable gate arm in the second arm of the telescopic gate arm while the railroad crossing gate goes from the closed position to an open position.

DETAILED DESCRIPTION

To facilitate an understanding of embodiments, principles, and features of the present invention, they are explained hereinafter with reference to implementation in illustrative embodiments. In particular, they are described in the context of being a gate with an arm such that it closes the railway crossing yet the gate arm remains relatively short when in the "up" position. The gate arm also mechanically operates. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
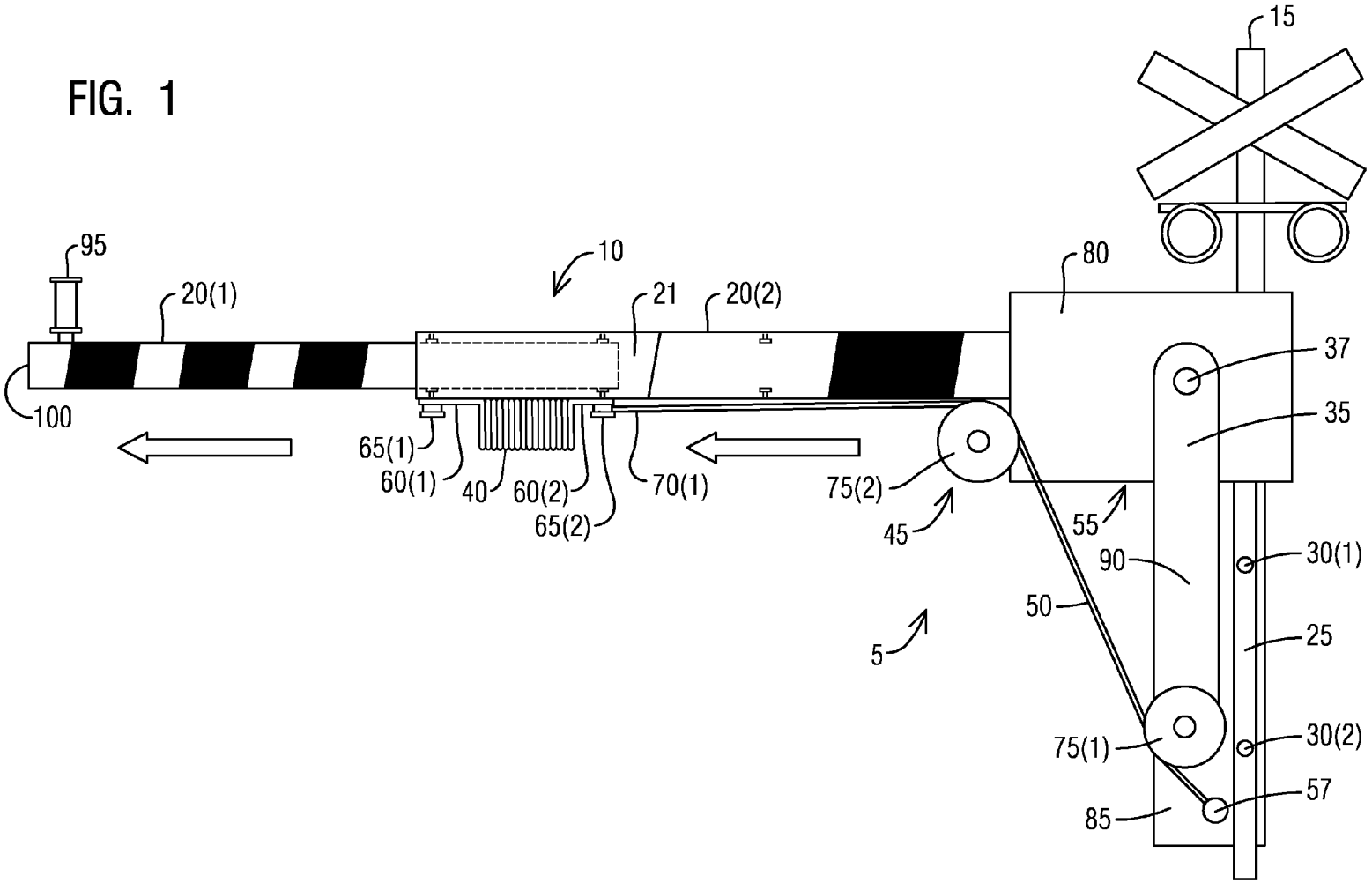
FIG. 1 illustrates a schematic diagram of a system for operating a gate arm of a railroad crossing gate with the gate arm being shown in an extended position in accordance with an exemplary embodiment of the present invention.

FIG. 1 illustrates a schematic diagram of a system 5 for operating a gate arm such as a telescopic gate arm 10 of a railroad crossing gate 15 with the gate arm 10 being shown in an extended position in accordance with an exemplary embodiment of the present invention. The system 5 comprises the telescopic gate arm 10 including a first arm 20(1) and a second arm 20(2) having a housing 21 for housing the first arm 20(1). The system 5 includes means for coupling the telescopic gate arm 10 to a post 25 of the railroad crossing gate 15. For example, in one embodiment, screws 30(1-2) may be used for this purpose.

The telescopic gate arm 10 extends outwardly from the post 25. Telescopic gate arm 10 is pivotally mounted on or near the post 25 so as to be normally moveable upwardly or downwardly in a vertical plane to block the road when actuated by an approaching train. The railroad crossing gate 15 also includes a counterbalancing mechanism that assists in raising and lowering the telescopic gate arm 10. The telescopic gate arm 10 may be a hollow, elongated member of any desired cross-sectional shape and made of impact resistant material, such as polycarbonate, so that the telescopic gate arm 10 will have sufficient rigidity.

In one embodiment, the telescopic gate arm 10 is configured to provide for swingable movement in a generally vertical plane from an upright position not blocking the crossing to a lowered position blocking the crossing when force is applied to the arm and providing for return of the arm to its original position not blocking the crossing when the force is removed. The telescopic gate arm 10 is mounted so that it will swing out of the way and return to its original position if struck by a moving vehicle from either direction. The railroad crossing gate 15 and the telescopic gate arm 10 is constructed of an impact-resistant material.

The system 5 further includes means for mechanically extending the first arm 20(1) of the telescopic gate arm 10 out of the second arm 20(2) of the telescopic gate arm 10 when the railroad crossing gate 15 is in a closed position in that the first arm 20(1) is extended out as shown in FIG. 1. In one embodiment, the means for mechanically extending the first arm 20(1) include a lever 35 pivoted via a pin 37, a spring 40 attached to the second arm 20(2), a cable mechanism 45 including a cable 50 and a crossing mechanism 55. The lever 35 may be movably coupled to the cable 50 and the spring 40 may be coupled to the cable 50.

The lever 35 may be coupled to the crossing mechanism 55 via the pin 37 and the cable 50 may be fixedly coupled to the crossing mechanism 55 via a lug 57. The crossing mechanism 55 is fixedly coupled to the railroad crossing gate 15. The cable mechanism 45 may be configured to extend and retract the first arm 20(1) and the lever 35 may be configured to enable the spring 40 to pull the first arm 20(1) out from a retracted position.

The spring 40 may comprise first and second ends 60(1-2). The spring 40 on the first end 60(1) may be coupled to a first lug 65(1) that is fixedly attached to a fixed portion of the telescopic gate arm 10, i.e., the second arm 20(2). The spring 40 on the second end 60(2) may be coupled to a second lug 65(2) that is fixedly attached to the first arm 20(1).

The cable 50 may comprise first and second ends 70(1-2). The second end of the spring 60(2) may be coupled to the first end 70(1) of the cable 50. The cable mechanism 45 is configured to hold and release a tension that in turn extends and retracts the first arm 20(1). The lever 35 is configured to control the tension so that when the telescopic gate arm 10 is lowered a slack is introduced into the cable 50 thereby enabling the spring 40 to pull the first arm 20(1) out from the retractable position in which the first arm 20(1) is retracted.

The lever 35 may comprise a first roller 75(1) and the cable mechanism 45 may include a second roller 75(2) such that the cable 50, the lever 35, the first roller 75(1), and the second roller 75(2) are all configured to operate collaboratively to extend and retract the first arm 20(1). The cable 50 is fed out through the first and second rollers 75(1-2) as the first arm 20(1) moves into a position to release the slack. The first and second rollers 75(1-2) may be pulleys in one embodiment.

The crossing mechanism 55 is coupled to a railway crossing mechanism which is capable of lifting the telescopic gate arm 10 from a gate closed position to a gate opened position. The railway crossing mechanism is also capable of maintaining these both positions and transitioning between these two positions in response to a control signal, indicating closing of the railroad crossing gate 15 or opening of the railroad crossing gate 15.

The crossing mechanism 55 may comprise an element 80 coupled to a post 85. The second end 70(2) of the cable 50 may be fixedly coupled to the post 85 via the lug 57. The lever 35 may be pivoted at the element 80 (shown as a block, e.g., a block of counter weight as is known in a typical railroad crossing gate). The first roller 75(1) which is a deep V-type pulley may be located at a distal end 90 of the lever 35. The second roller 75(2) may be attached to the element 80 at an outer edge. The cable 50 may be connected to the post 85 such that the cable 50 passes on lower or bottom edge of the first roller 75(1) and passes over the upper or top edge of the second roller 75(2). The first and second rollers 75(1-2) may be aligned to function in a same plane. The lever 35 may be aligned with the first and second rollers 75(1-2) to function in the same plane such that the cable 50 can roll over the first and second rollers 75(1-2) while expanding or shrinking the spring 40.

In operation, the telescopic gate arm 10 going from "down" position to an "up" position produces a clockwise turning force on the second roller 75(2) which is a deep V-type pulley. Upon application of the clockwise force the second roller 75(2) exerts a longitudinal force on the cable 50 (left to right in the figure). The force exerted on the cable is, in turn, transferred via the first roller 75(1) onto the spring 40. The reverse happens when the telescopic gate arm 10 goes from "up" position to a "down" position.

The system 5 is relatively simple, has few parts that requires essentially no maintenance, and it can be installed on existing supporting structure at a relatively low cost. In one embodiment, an existing railroad crossing gate may be retrofitted with the system 5 to provide a mechanically extendable arm gate. The system 5 can be readily attached to a post of an existing railway grade crossing system. The retrofitting will not in any way interfere with the normal, conventional operation of a railroad crossing gate and will make maintenance easier.

In one embodiment, the system 5 including the cable 50, the first and second rollers 75(1-2), the spring 40 and the lever 35 may be made of a metal suitable for exterior usage. For example, a rust proof coating may be used on these components.

In one embodiment, the system 5 has an adjustable length of the telescopic gate arm 10 so that it can be adjusted to match railway crossings of various dimensions. In one embodiment, one or more object detection sensors may be used by the railway crossing mechanism to detect a presence of vehicles and/or objects in the crossing area so that the telescopic gate arm 10 can be operated automatically.

One of ordinary skill in the art understands that the above spring-loaded cable mechanism can be implemented by many suitable ways, for example based on properties of materials of the cable 50, the first and second rollers 75(1-2), the spring 40 and the lever 35. One of ordinary skill in the art will appreciate that the spring-loaded cable mechanism can be embodied as separate mechanical components and/or can comprise additional mechanical components not described herein.

While particular embodiments are described in terms of a spring-loaded cable mechanism, the techniques described herein are not limited to a spring-loaded cable mechanism but can also use mechanisms with other mechanical forms, such as gear-based or piston-based mechanisms.

In one embodiment, the first arm 20(1) includes a handle 95 at a distal end 100 to manually retract the first arm 20(1) in case of an emergency. In this way, if an automobile or pedestrian gets "trapped" in the railway crossing, the spring 40 loaded first arm 20(1) could be easily retracted by hand via the handle 95, thus allowing the automobile or pedestrian to pass through the crossing.

In one embodiment, the means for mechanically retracting the first arm 20(1) of the telescopic extendable gate arm 10 in the second arm 20(2) of the telescopic gate arm 10 while the railroad crossing gate goes from the closed position to an open position to permit access across the railway crossing are the same as the means for mechanically extending the first arm 20(1) of the telescopic gate arm 10 out of the second arm 20(2) of the telescopic gate arm 10 when the railroad crossing gate 15 goes in a closed position in that the first arm 20(1) is extended out as shown in FIG. 1 for inhibiting access across the railway crossing.

Figure 2:
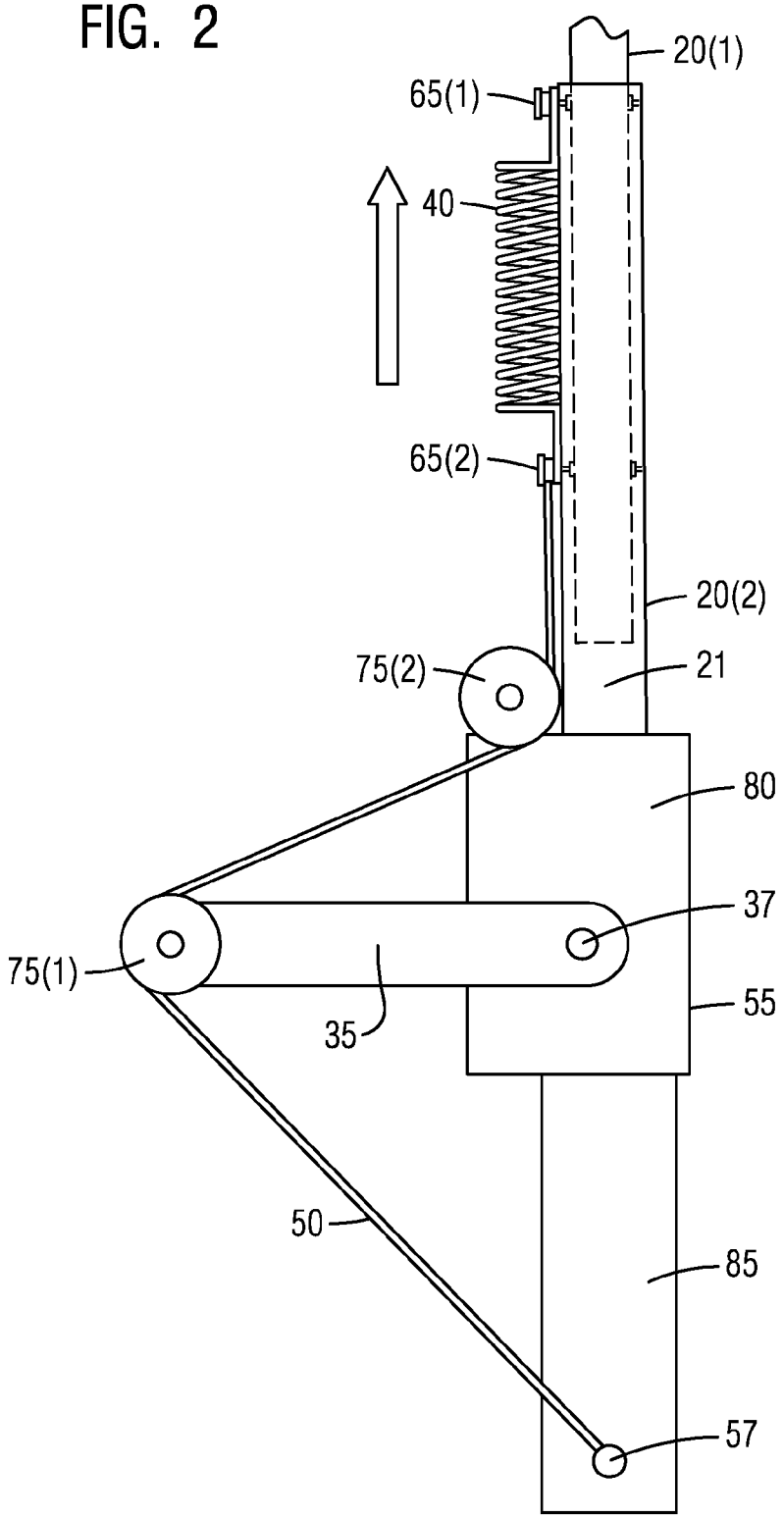
FIG. 2 illustrates a schematic diagram of the gate arm of the railroad crossing gate of FIG. 1 in a refracted position in accordance with an exemplary embodiment of the present invention.

FIG. 2 illustrates a schematic diagram of the telescopic gate arm 10 of the railroad crossing gate 15 of FIG. 1 in a retracted position in accordance with an exemplary embodiment of the present invention. The first arm 20(1) is being mechanically retracted while the telescopic gate arm 10 is switching between the "down" and "up" positions. Accordingly, the railroad crossing gate 15 is provided that completely closes the crossing yet remains relatively short when in the "up" position. This railroad crossing gate 15 can work with railway crossings which are in remote areas and have no power supply. This railroad crossing gate 15 provides a gate assembly which is self contained and uses no power.

In any of the foregoing embodiments, the system 5 of the railroad crossing gate 15 may be set up such that the telescoping action of the first/second arms 20(1-2) is not a complete telescoping range. That is, the range of telescoping movement can be adjusted to any length within the range of a zero-telescoping-position to a total-telescoping-position.

It should be noted that traffic at a railway crossing can be managed by employing the system 5 at the railroad crossing gate 15 according to any of the foregoing embodiments, or by employing more than one system 5 according to any of the foregoing embodiments.

Figure 3:
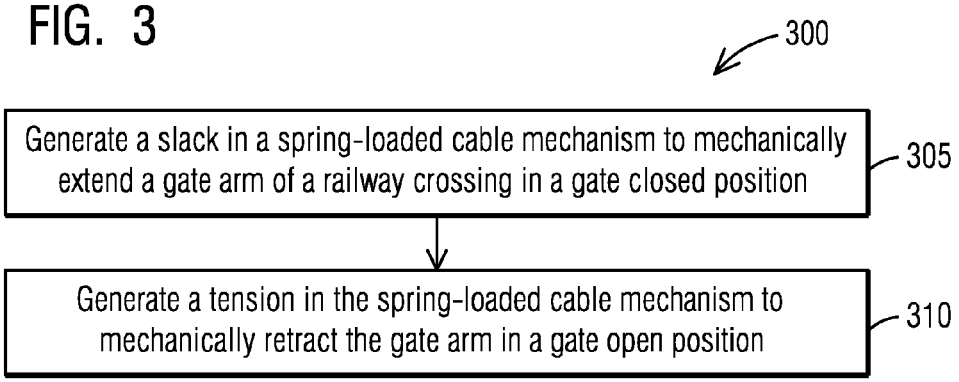
FIG. 3 illustrates a flow chart of a method for extending and retracting an extendable gate arm in accordance with an exemplary embodiment of the present invention.

FIG. 3 illustrates a flow chart of a method 300 for extending and retracting an extendable gate arm in accordance with an exemplary embodiment of the present invention. Reference is made to the elements and features described in FIGS. 1-2. It should be appreciated that some steps are not required to be performed in any particular order, and that some steps are optional.

In step 305, a slack is generated by a spring-loaded cable mechanism such as one in the system 5 of FIG. 1 to mechanically extend the telescopic gate arm 10 of a railway crossing in a gate closed position as shown in FIG. 1. In step 310, a tension is generated by the same spring-loaded cable mechanism such as one in the system 5 of FIG. 1 to mechanically retract the telescopic gate arm 10 in a gate opened position as shown in FIG. 2.

In another contemplated embodiment, the invention includes the entire crossing gate arm system. For example, a crossing gate arm system includes a motor for lowering and raising an extendable gate arm such as the telescopic gate arm 10 of FIG. 1.

Figure 4:
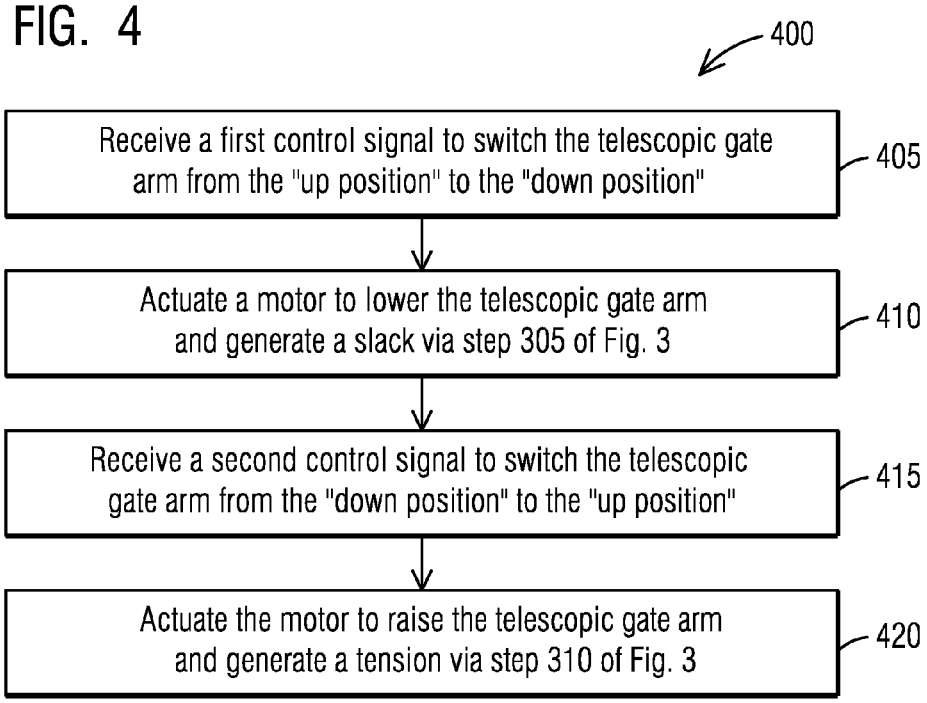
FIG. 4 illustrates a flow chart of a method of lowering and raising an extendable gate arm of a crossing gate arm system having a motor in accordance with an exemplary embodiment of the present invention.

FIG. 4 illustrates a flow chart of a method 400 of lowering and raising an extendable gate arm such as the telescopic gate arm 10 of FIG. 1 of the crossing gate arm system having the motor in accordance with an exemplary embodiment of the present invention. Reference is made to the elements and features described in FIGS. 1-2. It should be appreciated that some steps are not required to be performed in any particular order, and that some steps are optional.

In step 405, a first control signal is received to switch the telescopic gate arm 10 from the "up position" to the "down position." In step 410, the motor of the crossing gate arm system is actuated to lower the telescopic gate arm 10. The spring-loaded cable mechanism of FIG. 1 generates a slack as described in step 305 of FIG. 3.

In step 415, a second control signal is received to switch the telescopic gate arm 10 from the "down position" to the "up position." In step 420, the motor of the crossing gate arm system is actuated to raise the telescopic gate arm 10. The spring-loaded cable mechanism of FIG. 1 generates a tension as described in step 310 of FIG. 3.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A system for mechanically extending or retracting an extendable gate arm of a railroad crossing gate, the system comprising:

a lever having a first distal end and a second distal end, wherein a first roller is directly coupled at the first distal end of the lever;

a spring having first and second ends, the first end of the spring is coupled to a first lug that is fixedly attached to a fixed portion of the extendable gate arm and the second end of the spring is coupled to a second lug that is fixedly attached to the extendable gate arm;

a cable mechanism including a second roller and a cable having first and second ends, the lever movably coupled to the cable, the second end of the spring coupled to the first end of the cable, the second roller coupled to a crossing mechanism; and the crossing mechanism comprising a block coupled to a post for lifting the extendable gate arm from a gate closed position to a gate opened position and vice versa, wherein the second distal end of the lever is rotatably attached to the post via a pin and the second end of the cable coupled to the post, wherein the cable mechanism is configured to hold and release a tension in the cable mechanism that in turn extends and retracts the extendable gate arm, and wherein the lever is configured to control the tension so that when the extendable gate arm is lowered a slack is introduced into the cable thereby enabling the spring to pull the extendable arm out from a base position in which the extendable gate arm is retracted.

2. The system of claim 1, wherein the cable, lever, first roller, and the second roller are all configured to operate collaboratively to extend and retract the extendable gate arm.

3. The system of claim 2, wherein the cable is fed out through the first and second rollers as the extendable gate arm moves into a position to release the slack.

4. The system of claim 1, wherein the crossing mechanism is fixedly coupled to the railroad crossing gate.

5. The system of claim 1, wherein the extendable gate arm includes a handle at a distal end to manually retract the extendable gate arm in case of an emergency.

6. The system of claim 1, wherein the extendable gate arm is extended out when the railroad crossing gate is in a closed position and the extendable gate arm is retracted in when the railroad crossing gate is in an open position.

* * * * *